US009146577B2

(12) United States Patent
Kim et al.

(10) Patent No.: US 9,146,577 B2
(45) Date of Patent: Sep. 29, 2015

(54) PEDAL ASSEMBLY FOR PROTECTING DRIVER

(71) Applicants: Hyundai Motor Company, Seoul (KR); DONG HEE INDUSTRIAL CO., LTD., Ulsan (KR)

(72) Inventors: Eun Sik Kim, Daegu (KR); Jeong Seon Min, Hwaseong-si (KR); Ean Soo Cho, Hwaseong-si (KR); Yang Rae Cho, Hwaseong-si (KR); Wi Sang Park, Ulsan (KR)

(73) Assignees: HYUNDAI MOTOR COMPANY, Seoul (KR); DONG HEE INDUSTRIAL CO., LTD., Ulsan (KR)

( * ) Notice: Subject to any disclaimer, the term of this patent is extended or adjusted under 35 U.S.C. 154(b) by 37 days.

(21) Appl. No.: 13/710,380

(22) Filed: Dec. 10, 2012

(65) Prior Publication Data

US 2014/0116191 A1 May 1, 2014

(30) Foreign Application Priority Data

Oct. 25, 2012 (KR) ..... 10-2012-0119268

(51) Int. Cl.
*G05G 1/30* (2008.04)
*G05G 1/327* (2008.04)

(52) U.S. Cl.
CPC ..... *G05G 1/327* (2013.01); *Y10T 74/20528* (2015.01)

(58) Field of Classification Search
USPC ..... 74/512, 513, 560; 180/271, 281; 280/748
See application file for complete search history.

(56) References Cited

U.S. PATENT DOCUMENTS

| | | | | |
|---|---|---|---|---|
| 6,070,489 | A * | 6/2000 | Ananthasivan et al. | 74/512 |
| 6,176,340 | B1 * | 1/2001 | Mizuma et al. | 180/274 |
| 7,458,293 | B2 * | 12/2008 | Terradas et al. | 74/512 |
| 7,665,565 | B2 * | 2/2010 | Tokumo et al. | 180/274 |
| 7,926,383 | B2 * | 4/2011 | Choi et al. | 74/512 |
| 2006/0162481 | A1 * | 7/2006 | Sato | 74/512 |

FOREIGN PATENT DOCUMENTS

| | | | |
|---|---|---|---|
| KR | 10-2005-0037756 | A | 4/2005 |
| KR | 10-2005-0046132 | A | 5/2005 |
| KR | 10-0820240 | B1 | 4/2008 |
| KR | 10-2012-0060929 | A | 6/2012 |

* cited by examiner

*Primary Examiner* — Vicky Johnson
(74) *Attorney, Agent, or Firm* — Morgan, Lewis & Bockius LLP

(57) ABSTRACT

A pedal assembly protects a driver, in which a pedal arm 50 is prevented from pivoting to a driver and forced to pivot forward away from the driver in a collision or a rear-end collision, so that it is possible to maximally preclude an injury of the leg of the driver due to the pedal arm 50.

7 Claims, 10 Drawing Sheets

PEDAL ASSEMBLY FOR PROTECTING DRIVER

CROSS-REFERENCE TO RELATED APPLICATION

The present application claims priority of Korean Patent Application Number 10-2012-0119268 filed Oct. 25, 2012, the entire contents of which application is incorporated herein for all purposes by this reference.

BACKGROUND OF INVENTION

1. Field of Invention

The present invention relates to a pedal assembly for protecting a driver in a vehicle, and more particularly to a pedal assembly for protecting a driver in a vehicle which can maximally preclude an injury of the driver's legs (hit against the shin, bending of the ankles, and the like) due to a pedal assembly in a collision or a rear-end collision.

2. Description of Related Art

In common vehicles, an acceleration pedal, a brake pedal, and a clutch pedal that are operated by a driver are mounted on the dash panel under the driver seat.

When the engine room is crushed by too large shock power generated in a collision or a rear-end collision, the driver's legs are injured by the pedals.

That is, as a dash panel 1 and a pedal member 2 are pushed rearward by shock power, a pedal arm 3 is correspondingly pushed rearward, as indicated by an arrow M1 and the lower end of the pedal pivots up about a pedal hinge shaft 4, as indicated by and arrow R1.

In this case, if the driver does not press down the pedal with a foot, the end of the pivoting pedal hits the shin of the driver and the driver's leg is injured, or when the driver presses down the pedal with a foot, the driver's ankle is thrown and bent back by the pivoting pedal, so that the driver is injured.

Therefore, in order to solve the problem, a pedal assembly with a safety mechanism that can minimize an injury of a leg of a driver by a pedal by separating a pedal member 2 from a cowl bracket 5 such that a pedal arm 3 moves down and by forcing the pedal arm 3 to pivot forward as indicated by the arrow R2 such that the pedal arm 3 moves away as far as possible from a leg of a driver, when the pedal member 2 is pushed rearward in a collision, has been proposed.

However, the pedal assembly described above has a defect that the cost and weight considerably increase because there are too many components in the safety mechanism, and particularly, the pedal arm 3 cannot be forced to pivot, when the pedal member 2 and the cowl bracket 5 are not separated, so that a leg of a driver is more seriously injured because the pedal arm 3 further pivots, and it is necessary to satisfy a condition that the cowl panel 6 should be pushed rearward further than a dash panel 1 even though the pedal member 2 is pushed rearward.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to solve the above-described problems associated with prior art. Various aspects of the present invention provide for a pedal assembly for protecting a driver which can maximally preclude an injury of the driver's legs (hit against the shin and bending of the ankles) due to a pedal assembly by guide the pedal arm to pivot forward with contact with a cowl bracket when a pedal member is pushed rearward in a collision or a read-end collision, and particularly, to reduce the weight and cost by minimizing the number of components that guides forward pivot of the pedal arm, to more improve the guide of forward pivot of the pedal arm by forcing the pedal arm to pivot forward even if the pedal member is not separated from a cowl panel or a cowl bracket, and to more increasing the performance of protecting a driver.

Various aspects of the present invention provide for a pedal assembly for protecting a driver that includes: a reverse lever that is rotatably coupled to the upper rear portion of a pedal arm by a lever hinge shaft; and a pedal arm that has the upper end rotatably coupled to the pedal hinge shaft ahead of the lever hinge shaft and is separated from the pedal member by a rotational force of a reverse lever when the pedal member is pushed rearward and the reverse lever rotates in contact with a fixed member of a car body in a collision or a rear-end collision.

The pedal member may include: a dash panel connector that is fixed to the dash panel and the pedal hinge shaft passes through; a cowl pane connector that is connected with the upper end of the dash panel connector and combined with a cowl panel; and a lever connector that is combined with the cowl panel connector and has a rear protrusion that the lever hinge shaft passes through.

A bush pipe may be integrally disposed at the upper end of the pedal arm, the pedal hinge shaft is disposed through the pedal member and the bush pipe, and the bush pipe is rotatable with respect to the pedal hinge shaft.

The reverse lever may include: a lever connector that the lever hinge shaft passes through; an upper fork and a lower fork that integrally protrude forward at the upper and lower portions of the lever connector to make an U-shape with the lever connector and surround the upper and lower portions of the bush pipe; and a lever protrusion that protrudes upward above the lever connector and comes in contact with a cowl bracket when the pedal member is pushed rearward.

The lever connector, the upper fork, and the lower fork may be formed in pairs opposite to each other at the left and right sides, the lever connectors are connected by a connecting portion, and the lever protrusion is positioned on the connecting portion.

The pair of lower forks may be connected by a lever pin, and a pedal arm protrusion that comes in contact with the lever pin when the reverse lever pivots in contact with the cowl bracket integrally protrudes from the pedal arm.

As the pedal arm may pivot about the pedal hinge shaft, the pedal arm protrusion does not come in contact with the lever pin, in the normal status without an accident.

The reverse lever may include: a lever connector that the lever hinge shaft passes through; an upper protrusion that is integrally formed to protrude upward from the lever connector and comes in contact with the cowl bracket when the pedal member is pushed rearward; and a lower protrusion that is integrally formed to protrude downward from the lever connector, and comes in contact with the bush pipe and provides a force to push the bush pipe rearward, when the reverse lever pivots about the lever hinge shaft, with the upper protrusion in contact with the cowl bracket.

A shaft hole that the pedal hinge shaft passes through may be formed at the pedal member, and the shaft hole is connected with the outer edge of the pedal member through a connection passage.

A retaining protrusion that prevents the pedal hinge shaft from coming out from the shaft hole by the own weight integrally may protrude from the joint between the shaft hole and the connection passage.

A shaft hole that the pedal hinge shaft passes through may be formed at the pedal member, and a notch that is cut by the pedal hinge shaft when the reverse lever applies a force to the pedal hinge shaft while pivoting may be formed in the shaft hole to face the outer edge of the pedal member.

The gap from the end of the notch to the outer edge of the pedal arm in the radial direction of the shaft hole may be smaller than the diameter of the shaft hole.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIGS. 8 to 10 are views showing an exemplary pedal assembly for protecting a driver which is equipped with a reverse lever according to the present invention, in which FIG. 8 is a view showing when the assembly is installed.

FIGS. 9 and 10 are views illustrating the operation in a collision.

Figure 1:
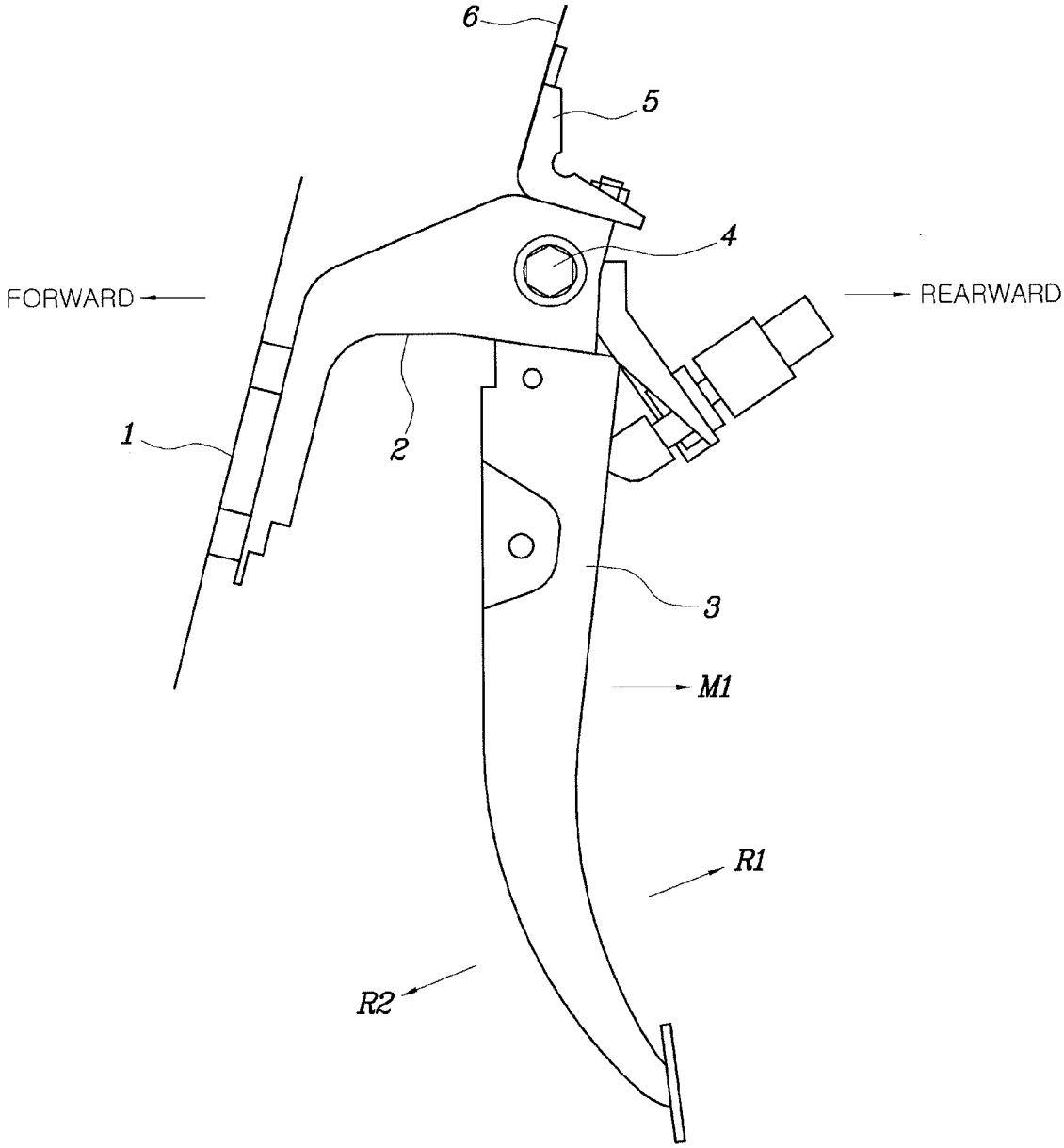
FIG. 1 (Prior Art)
FIG. 1 is a side view of a pedal assembly of the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
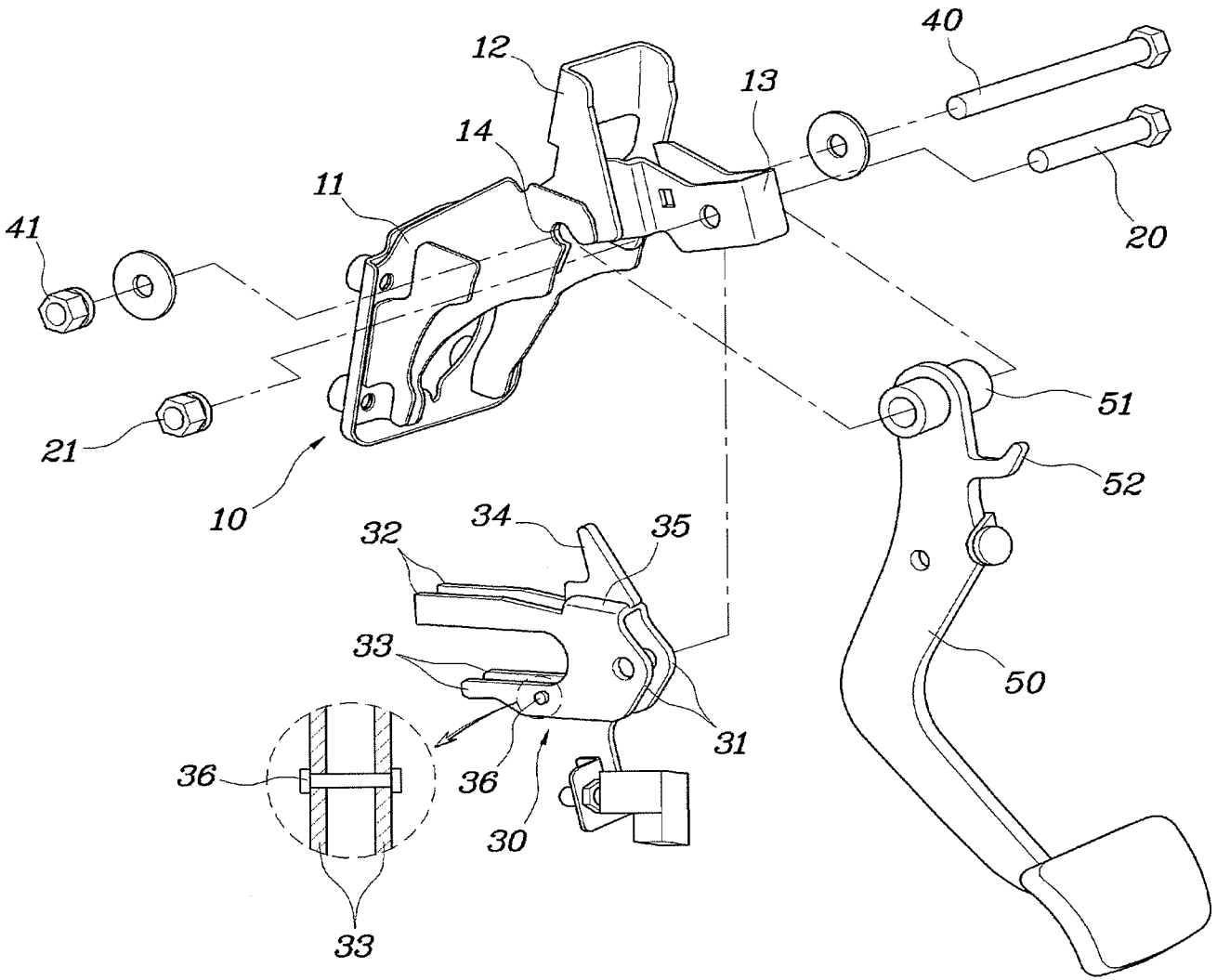
FIG. 2 is an exploded perspective view showing an exemplary pedal assembly for protecting a driver which is equipped with a reverse lever according to the present invention.
Figure 10:
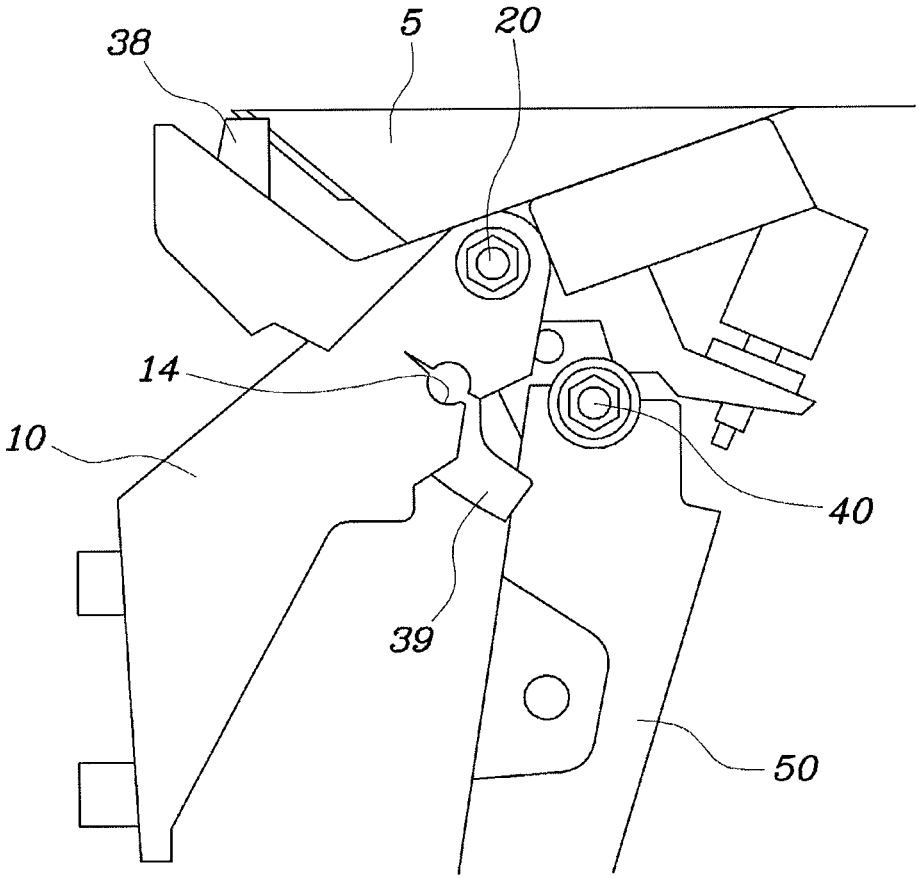

A pedal assembly for protecting a driver according to the present invention, as shown in FIGS. 2 and 10, includes a reverse lever that is rotatably coupled to the upper rear portion of a pedal arm 50 by a lever hinge shaft 20 and a pedal arm 50 that has the upper end rotatably coupled to the pedal hinge shaft 40 ahead of the lever hinge shaft 20 and is separated from the pedal member 10 by a rotational force of a reverse lever 30 when the pedal member 10 is pushed rearward and the reverse lever 30 rotates in contact with a fixed member (cowl bracket or a cowl crossbar) of a car body in a collision or a rear-end collision.

That is, the pedal member 10 includes a dash panel connector 11 that is fixed to the dash panel 1 and the pedal hinge shaft 40 passes through, a cowl panel connector 12 that is connected with the upper end of the dash panel connector 11 and combined with a cowl panel 6, and a lever connector 13 that is combined with the cowl panel connector 12 and has a rear protrusion that the lever hinge shaft 20 passes through.

The lever connector 13 is a bracket formed in a U-shape with both ends integrally coupled to the cowl panel connector 12 and the middle portion protruding backward, and the reverse lever 30 is disposed to be rotatable about the lever hinge shaft 20 toward the front of a vehicle, inside the lever connector 13. One will appreciate that the lever and the cowl panel connectors may be monolithically formed.

The lever hinge shaft 20 is thread-fastened in a nut 21 through the lever connector 13 and the pedal hinge shaft 40 is thread-fastened in a nut 41 through the dash panel connector 11.

A bush pipe 51 is integrally disposed at the upper end of the pedal arm 50 and the pedal hinge shaft 40 is disposed through the dash panel connector 11 and the bush pipe 51, so that the pedal arm 50 and the bush pipe 51 are disposed to be rotatable about the pedal hinge shaft 40. One will appreciate that the bush pipe and the pedal arm may be monolithically formed.

Meanwhile, the reverse lever 30 may take various forms. For example, the configuration shown in FIGS. 2 to 7 includes a lever connector 31 that the lever hinge shaft 20 passes through, an upper fork 32 and a lower fork 33 that are integrally formed to protrude from the upper and lower portions of the lever connector 31, making a U-shape in cooperation with the lever connector 31, and surround the upper and lower portions of the bush pipe 51, and a lever protrusion 34 that protrudes upward above the lever connector 31 and comes in contact with the cowl bracket 5 when the pedal member 10 is pushed rearward. One will appreciate that the upper and lower forks may be monolithically formed with the lever connector.

The lever connector 31, the upper fork 32, and the lower fork 33 may be formed in pairs opposite each other at the left and right sides to improve strength and achieve more precise operation, in which the pair of lever connectors 31 are connected by a connecting portion 35 and the lever protrusion 34 is positioned on the connecting portion 35.

Further, the pair of lower fork 33 is connected by a lever pin 36, and when the reverse lever 30 has the lever pin 36, a pedal arm protrusion integrally protrudes from the pedal arm 50; therefore, the pedal arm protrusion 52 comes in contact with the lever pin 36 when the reverse lever 30 pivots in contact with the cowl bracket 5, so that the pedal arm 50 pivots forward. One will appreciate that the protrusion may be monolithically formed with the pedal arm.

In the normal status without an accident, as the pedal arm 50 pivots about the pedal hinge shaft 40, the pedal arm protrusion 52 may not come in contact with the lever pin 36.

Figure 8:
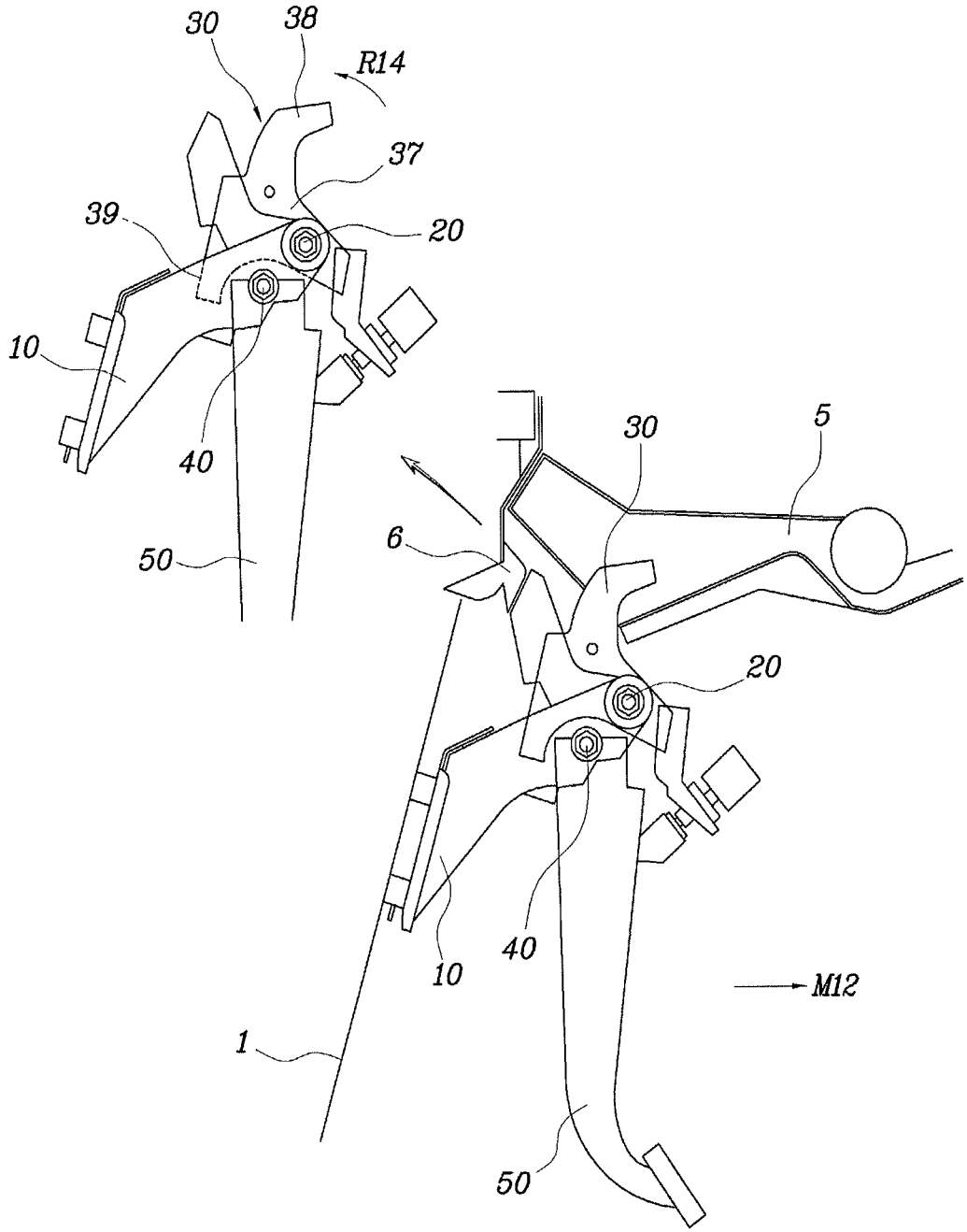
Figure 9:
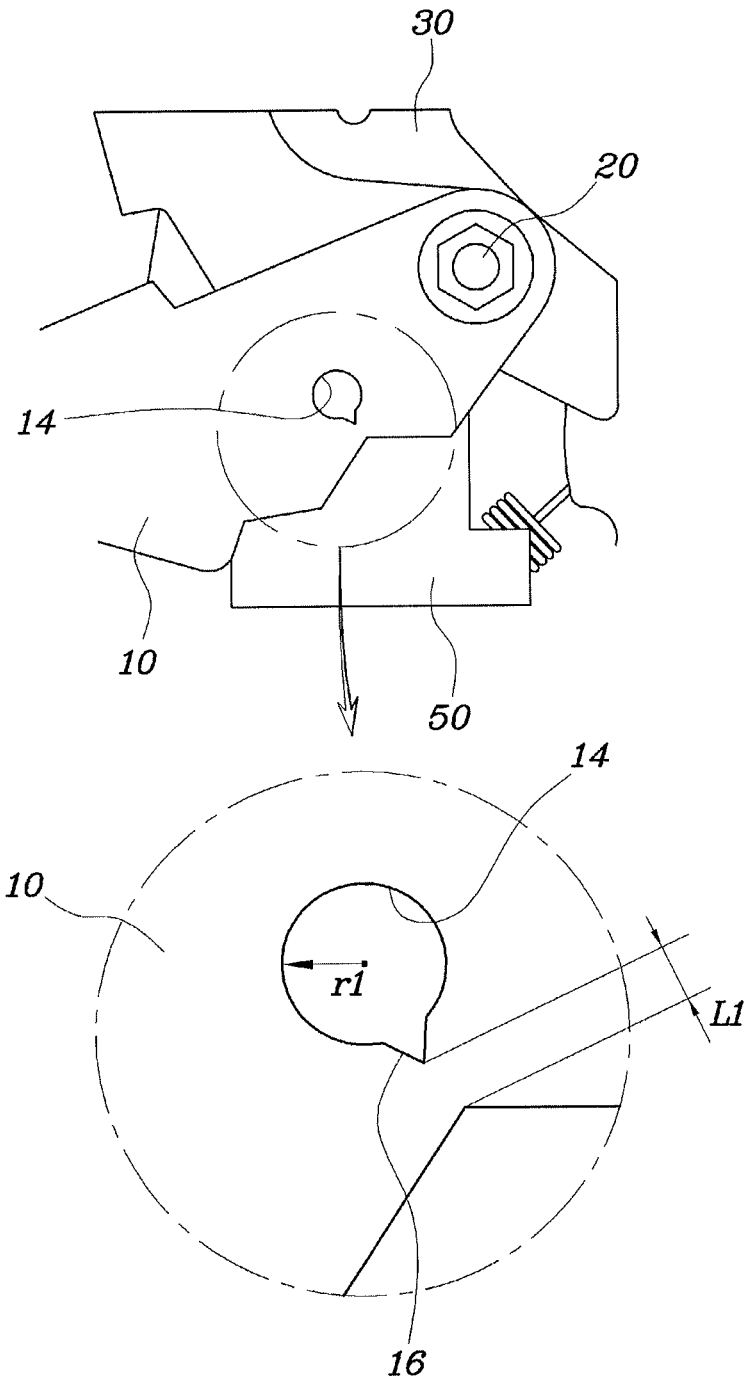

The configuration of reverse lever 30 shown in FIGS. 8 to 10 includes a lever connector 37 that the lever hinge shaft 20 passes through, an upper protrusion 38 that is integrally formed to protrude upward from the lever connector 37 and comes in contact with the cowl bracket 5 when the pedal member 10 is pushed rearward, and a lower protrusion 39 that is integrally formed to protrude downward from the lever connector 37, and comes in contact with the bush pipe 51 and pushes the bush pipe 51 rearward, when the reverse lever 30 pivots about the lever hinge shaft 20, with the upper protrusion 38 in contact with the cowl bracket 5. One will appreciate that the upper protrusion may be monolithically formed with the lever connector.

Further, a shaft hole 14 that the pedal hinge shaft 40 passes through is formed at the pedal member 10, and, as shown FIGS. 2 to 7, may be connected with the outer edge of the pedal member 10 through a connection passage 15, or as shown in FIGS. 8 to 10, a notch 16 that is cut by the pedal hinge shaft 40 when the reverse lever 30 applies a force to the pedal hinge shaft 40 while pivoting may be formed in the shaft hole 14 to face the outer edge of the pedal member 10.

When the shaft hole 14 is open to be connected with the outer edge of the pedal member 10 through the connection passage 15, a retaining protrusion 17 that prevents the pedal hinge shaft 40 from coming out from the shaft hole 14 by the own weight may integrally protrude from the joint between the shaft hole 14 and the connection passage 15.

Alternatively, when the notch 16 is formed in the shaft hole 14, the gap L1 from the end of the notch 16 to the outer edge of the pedal member 10 in the direction of the radius r1 of the shaft hole 14 may be smaller than the diameter of the shaft hole 14.

That is, when the notch 16 is formed in the shaft hole 14, the pedal hinge shaft 40 is supposed to be separated from the pedal member 10, tearing the notch 16, when the reverse lever 30 applies a force to the pedal hinge shaft 40 while pivoting.

Therefore, when the gap L1 from the end of the notch 16 to the outer edge of the pedal member 10 is larger than the diameter of the shaft hole 14, rigidity of the pedal member 10 increases, so that the pedal hinge shaft 40 is difficult to be separated from the pedal member 10 while tearing the notch 16; therefore, the gap L1 from the end of the notch 16 to the outer edge of the pedal member 10 may be larger than 0 and smaller than the diameter of the shaft hole 14.

On the other hand, when the shaft hole 14 is open to be connected with the outer edge of the pedal member 10 through the connection passage 15, the reverse lever 30 may have the upper and lower forks 32 and 33, as shown in FIGS. 1 to 7, and when the shaft hole 14 is not open, but simply has the notch 16 on the inner circumferential surface, the reverse lever may simply have the upper and lower protrusions 38 and 39, as shown in FIGS. 8 to 10.

Hereafter, the operation of the pedal assembly of various embodiments of the present invention is described, and the assembly illustrated in FIGS. 2 to 7 is described first.

Figure 3:
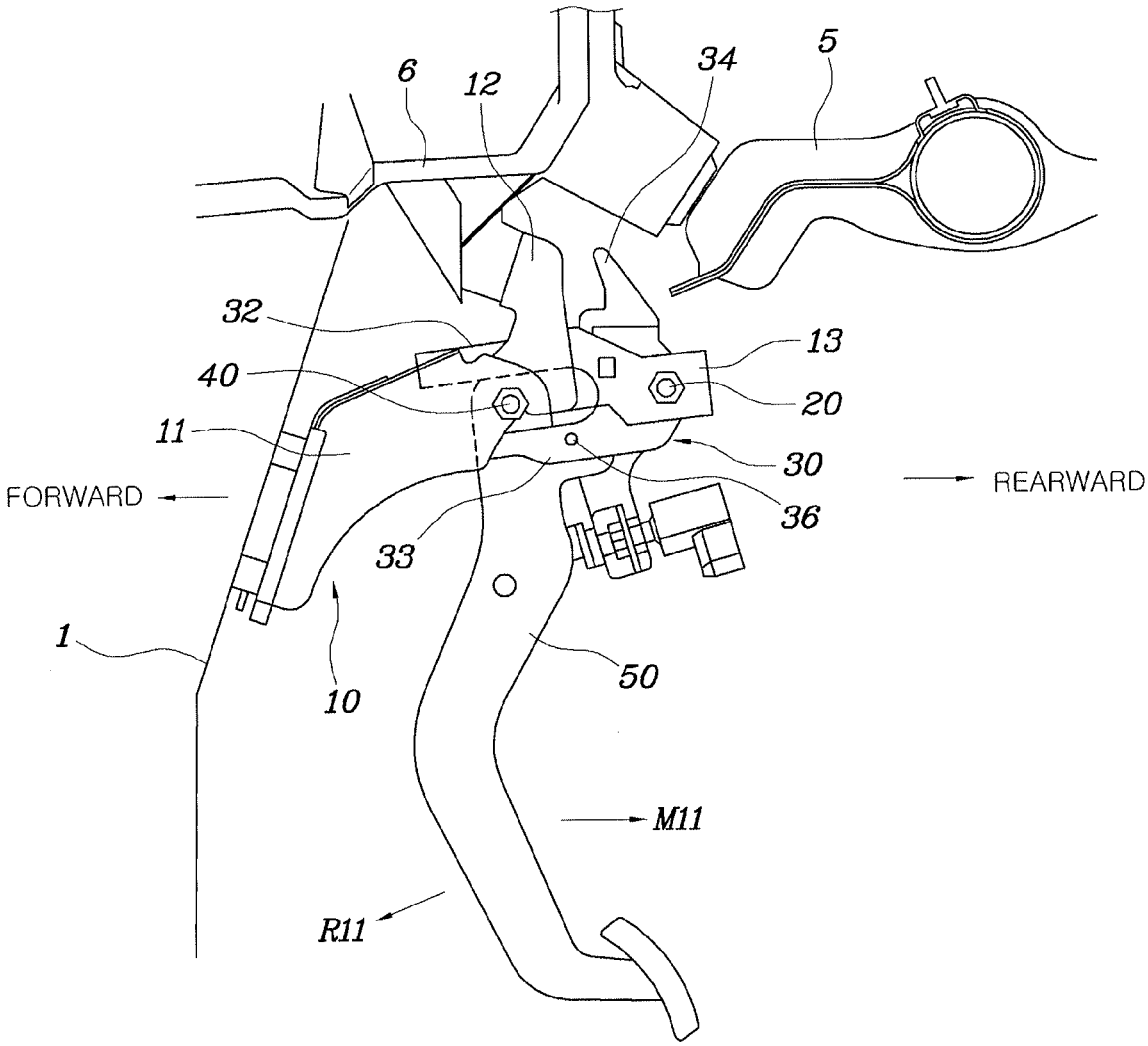
FIG. 3 is a view illustrating assembling the parts of the pedal assembly shown in FIG. 2.
Figure 4:
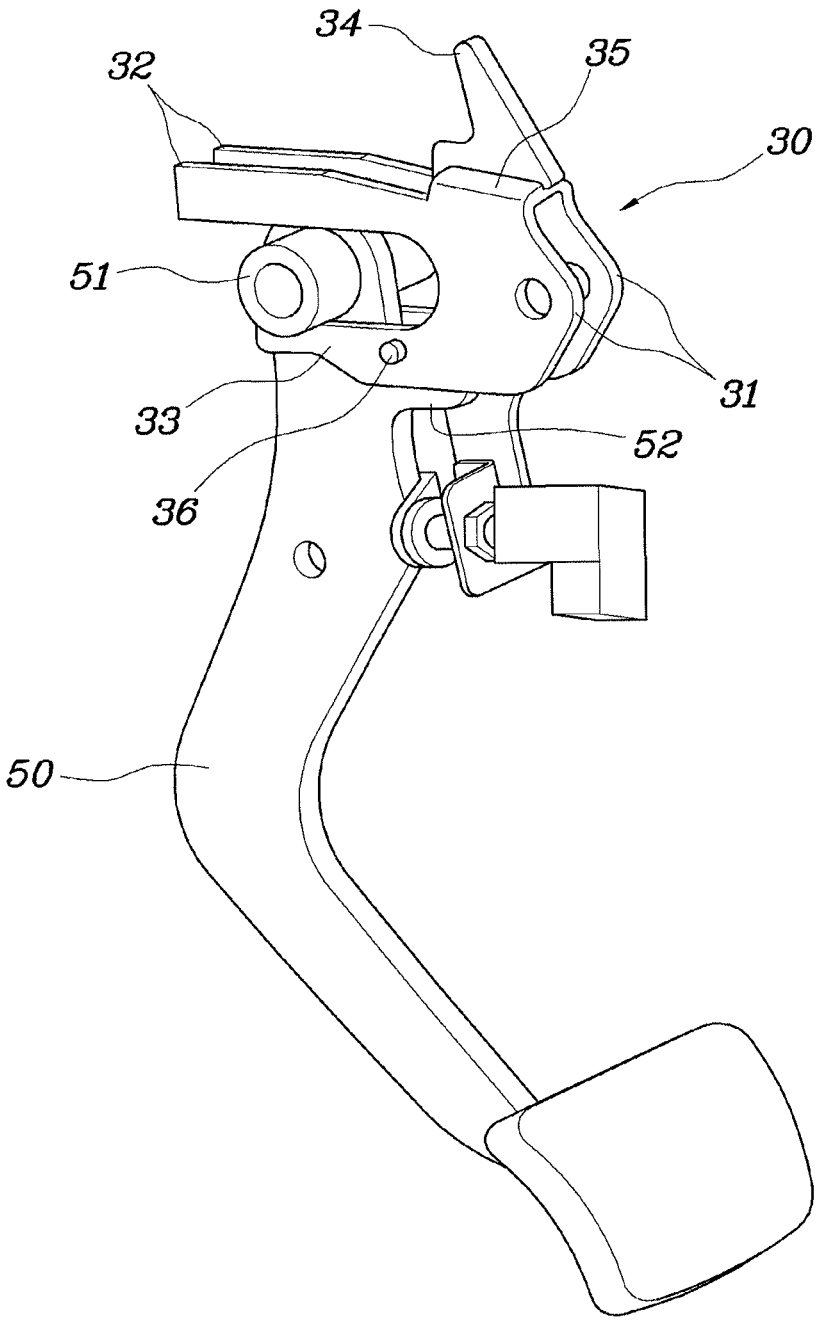
FIG. 4 is a view showing combination of a reverse lever and a pedal arm of the pedal assembly shown in FIG. 2.
Figure 5:
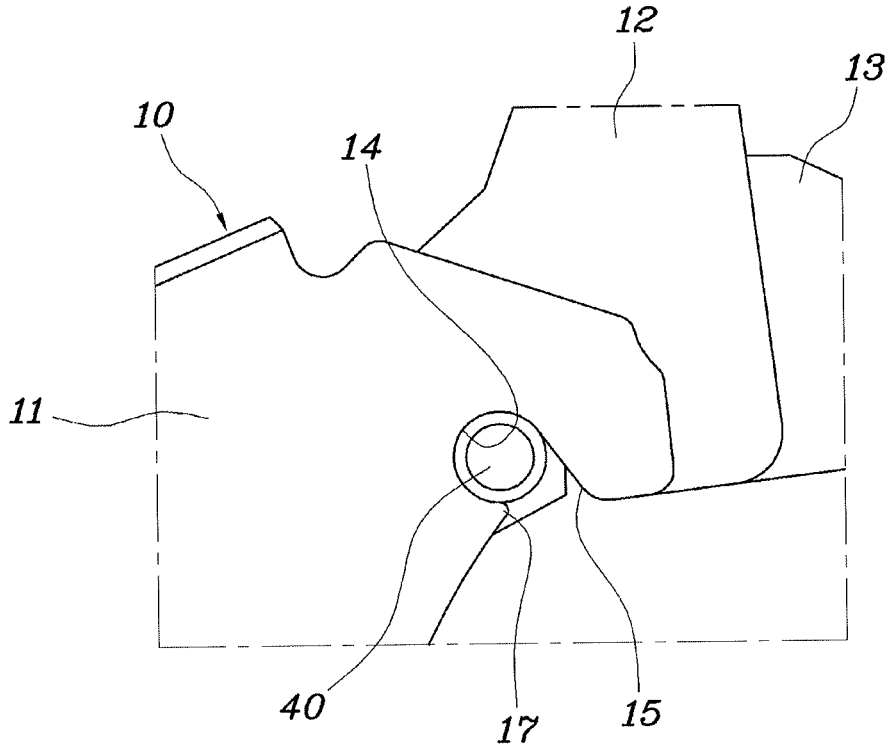
FIG. 5 is a view illustrating a shaft hole formed at a pedal member of the pedal assembly shown in FIG. 2.

In a normal status without a collision or a rear-end collision, as the driver presses down the pedal, the pedal arm 40 pivots forward about the pedal hinge shaft 40, as indicated by the arrow R11 shown in FIG. 3, in which the pedal arm protrusion 52 pivoting with the pedal arm 50 does not come in contact with the lever pin 36, so that the pedal arm 50 normally operates in the normal status without an accident.

Further, the lower fork 33 of the reverse lever 30 keeps supporting the lower end of the bush pipe 51 in the normal status without an accident, so that the pedal hinge shaft 40 does not come out from the shaft hole 14.

Further, when a collision and a rear-end collision occur and the pedal member 10 is pushed rearward (inside) while the dash panel 1 and the cowl panel 6 collapse by shock power due to the collision, the pedal arm 50 is correspondingly pushed rearward, as indicated by the arrow M11 in FIG. 3.

Figure 6:
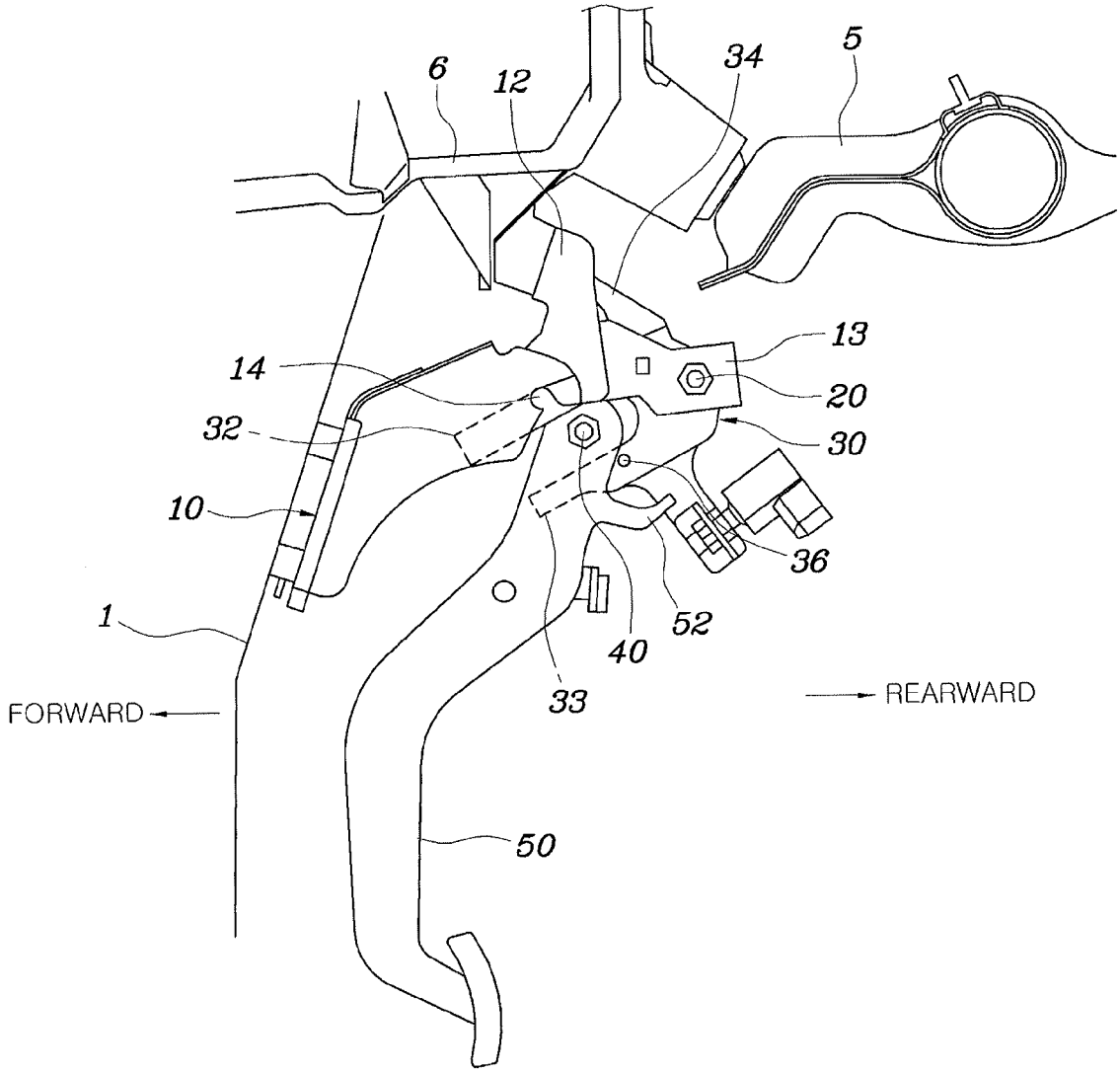
FIGS. 6 and 7 are views illustrating the operation in a collision of the pedal assembly shown in FIG. 2.
Figure 7:
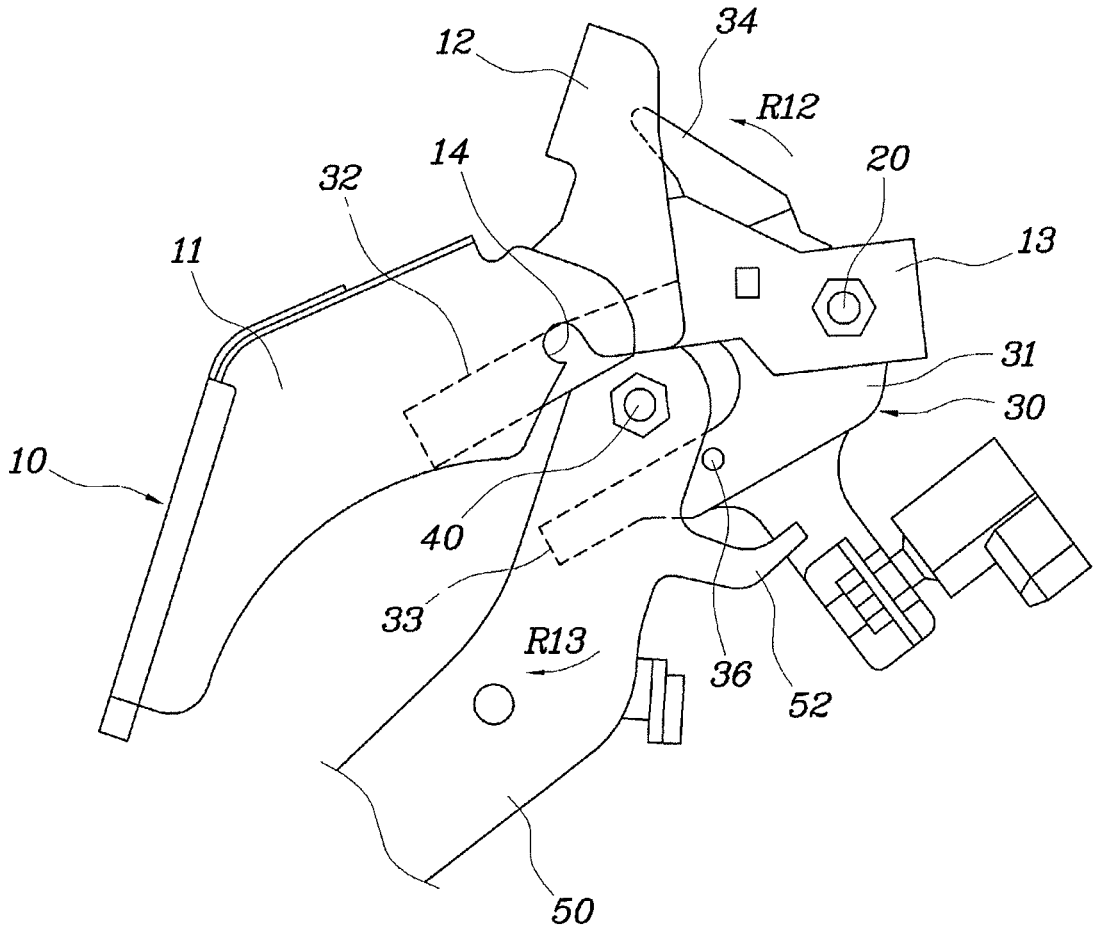

When the lever protrusion 34 of the reverse lever 30 comes in contact with the cowl bracket 5 while the pedal arm 50 is pushed rearward, as shown in FIG. 6, the reverse lever 30 starts to pivot counterclockwise about the lever hinge shaft 20, as indicated by the arrow R12 shown in FIG. 7, and the upper fork 32 of the reverse lever 30 presses the bush pipe 51, so that the pedal hinge shaft 40 comes out from the shaft hole 14, and as a result, the pedal arm 50 is separated from the pedal member 10.

Further, as the reverse lever 30 pivots counterclockwise, as indicated by the arrow R12, the lever pin 36 comes in contact with the pedal arm protrusion 52, and when the pedal arm 50 is separated from the pedal member 10 in this situation, the pedal arm 50 pivots forward, as indicated by the arrow R13 in FIG. 7, by the pressing force of the lever pin 36.

Therefore, the pedal assembly according to the present invention has the structure where the pedal arm 50 pivots forward away from the pedal member 10 by the operation of the reverse lever 30, when a collision and a rear-end collision occur, so that it is possible to maximally preclude an injury of the leg of the driver due to the pedal arm 50.

That is, as the pedal arm 50 forcibly pivot forward when an accident occurs, it is possible to prevent an injury that the shin of the driver is hit or the ankle of the driver is thrown and bent back by the pedal.

Further, since the pedal arm 50 is forced to pivot forward simply by the reverse lever 30 in an accident in the pedal assembly according to the present invention, it is possible to greatly reduce the weight and cost by reducing the number of components.

Further, since the pedal arm 50 can be forced to pivot forward as long as the reverse lever 30 comes in contact with the cowl bracket 5 while the pedal member 10 is simply pushed rearward without being separated from the cowl panel 6 or the cowl bracket 5 in an accident, it is possible to further improve guide forward pivot of the pedal arm 50 and thus to further improve the performance of protecting a driver in an accident.

The assembly shown in FIGS. 8 to 10 is described next.

The pedal hinge shaft 40 keeps supported to be rotatable by the shaft hole 14 with the notch 16 in a normal status without a collision and a rear-end collision.

Further, when a collision and a rear-end collision occur and the pedal member 10 is pushed rearward (inside) while the dash panel 1 and the cowl panel 6 collapse by shock power due to the collision, the pedal arm 50 is correspondingly pushed rearward, as indicated by the arrow M12 in FIG. 8.

When the upper protrusion 38 of the reverse lever 30 comes in contact with the cowl bracket 5 while the pedal arm 50 is pushed rearward, as described above, the reverse lever 30 starts to pivot counterclockwise about the lever hinge shaft 20, as indicated by the arrow R14 shown in FIG. 8, and the lower protrusion 39 of the reverse lever 30 presses the bush pipe 51, so that the pedal hinge shaft 40 comes out from the pedal member 10 while tearing the notch 16, as shown in FIG. 10, and as a result, the pedal arm 50 is separated from the pedal member 10.

Further, since the reverse lever 30 keeps pivot counterclockwise, even though the pedal arm 50 is separated from the pedal member 10, the lower protrusion 39 of the reverse lever 30 keeps pressing inside the upper end of the pedal arm 50, so that the lower end of the pedal arm 50 reversely pivots forward to the end.

Therefore, it is possible to prevent the pedal arm 50 from being pushed rearward in various embodiments of the present invention, so that it is possible to maximally preclude an injury of the leg of the driver due to the pedal arm 50, such as that the shin of the driver is hit or the ankle of the driver is thrown and bent back by the pedal.

Meanwhile, it should be noted that the pedal assembly can be applied to all of the pedals that are mounted in a vehicle, such as the brake pedal and the clutch pedal.

According to the pedal assembly for protecting a driver according to the present invention, since a pedal arm is prevented from pivoting to a driver and forced to pivot forward away from the driver in a collision or a rear-end collision, so that it is possible to maximally preclude an injury of the leg of the driver due to the pedal arm, and as the configuration for forcibly pivoting the pedal arm forward is simplified, it is possible to greatly reduce the weight and cost. Further, since the pedal arm can be forced to pivot forward even if the pedal arm is not separated from the cowl panel or the cowl bracket, it is possible to further improve guide of forward pivot of the pedal arm and to further improve the performance of protecting a driver.

For convenience in explanation and accurate definition in the appended claims, the terms upper or lower, front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A pedal assembly for protecting a driver comprising:

a reverse lever rotatably coupled to an upper rear portion of a pedal member by a lever hinge shaft; and a pedal arm that has an upper end rotatably coupled to a pedal hinge shaft ahead of the lever hinge shaft and is separated from the pedal member by a rotational force of the reverse lever when the pedal member is pushed rearward and the reverse lever rotates in contact with a fixed member of a car body in a collision or a rear-end collision;

wherein a bush pipe is integrally disposed at the upper end of the pedal arm;

wherein the pedal hinge shaft is disposed through the pedal member and the bush pipe;

wherein the bush pipe is rotatable with respect to the pedal hinge shaft;

wherein the reverse lever includes:

a lever connector that the lever hinge shaft passes through;

an upper fork and a lower fork that integrally protrude forward at upper and lower portions of the lever connector to make an U-shape with the lever connector and surround upper and lower portions of the bush pipe; and a lever protrusion that protrudes upward above the lever connector and comes in contact with a cowl bracket when the pedal member is pushed rearward; and wherein the lever connector, the upper fork, and the lower fork are formed in pairs opposite each other at left and right sides;

wherein the lever connectors are connected by a connecting portion;

wherein the lever protrusion is positioned on the connecting portion;

wherein the pair of lower forks are connected by a lever pin; and wherein a pedal arm protrusion that comes in contact with the lever pin when the reverse lever pivots in contact with the cowl bracket integrally protrudes from the pedal arm.

2. The pedal assembly of claim 1, wherein the pedal member includes:

a dash panel connector fixed to the dash panel, the pedal hinge shaft passing through the dash panel connector;

a cowl panel connector connected with the upper end of the dash panel connector and combined with a cowl panel; and a lever bracket that is combined with the cowl panel connector and has a rear protrusion that the lever hinge shaft passes through.

3. The pedal assembly of claim 1, wherein as the pedal arm pivots about the pedal hinge shaft, the pedal arm protrusion does not come in contact with the lever pin, in the normal status without an accident.

4. The pedal assembly of claim 1, wherein a shaft hole that the pedal hinge shaft passes through is formed at the pedal member, and the shaft hole is connected with the outer edge of the pedal member through a connection passage.

5. The pedal assembly of claim 4, wherein a retaining protrusion that prevents the pedal hinge shaft from coming out from the shaft hole by the own weight integrally protrudes from a joint between the shaft hole and the connection passage.

6. The pedal assembly of claim 1, wherein a shaft hole that the pedal hinge shaft passes through is formed at the pedal member, and a notch cut by the pedal hinge shaft when the reverse lever applies a force to the pedal hinge shaft while pivoting is formed in the shaft hole to face the outer edge of the pedal member.

7. The pedal assembly of claim 6, wherein a gap from the end of the notch to a portion of the pedal arm positioned in the radial direction r1 of the shaft hole is smaller than the diameter of the shaft hole.

* * * * *